US010674775B1

(12) United States Patent
Leigh

(10) Patent No.: US 10,674,775 B1
(45) Date of Patent: Jun. 9, 2020

(54) UNDERGARMENT SUPPORT APPARATUS AND SYSTEMS

(71) Applicant: Brent Leigh, Whistler (CA)

(72) Inventor: Brent Leigh, Whistler (CA)

( * ) Notice: Subject to any disclaimer, the term of this patent is extended or adjusted under 35 U.S.C. 154(b) by 0 days.

(21) Appl. No.: 16/383,566

(22) Filed: Apr. 12, 2019

(51) Int. Cl.
*A41D 13/05* (2006.01)
*A41B 9/02* (2006.01)

(52) U.S. Cl.
CPC ..... *A41D 13/0525* (2013.01); *A41B 9/023* (2013.01); *A41B 2400/60* (2013.01); *A41B 2500/30* (2013.01)

(58) Field of Classification Search
CPC ..... A41D 13/0525; A41D 2500/30; A41B 9/023; A41B 2400/60; A41B 9/02; A41B 9/026; A41B 9/008
USPC ..... 2/466, 403
See application file for complete search history.

(56) References Cited

U.S. PATENT DOCUMENTS 1,477,187 A * 12/1923 Rayne ..... A61F 5/40 602/71
1,610,531 A * 12/1926 Morrison ..... A61F 5/40 602/73
2,746,453 A * 5/1956 Johnson ..... A61F 5/40 602/70
2,888,014 A * 5/1959 Dougherty ..... A61F 5/40 602/70
3,499,442 A 3/1970 Steinmetz
3,517,666 A 6/1970 Atlee
3,621,846 A 11/1971 Lehman
4,022,196 A * 5/1977 Clinton ..... A61F 5/41 600/39
4,122,849 A 10/1978 Dietz
4,141,357 A 2/1979 Dietz
4,215,685 A 8/1980 Ibel
4,345,337 A 8/1982 Chung
4,414,971 A 11/1983 Chung
4,653,484 A * 3/1987 Cannon ..... A61F 5/41 600/39
4,660,551 A 4/1987 Nishimura
4,759,355 A 7/1988 Thrower
(Continued)

FOREIGN PATENT DOCUMENTS

CN 203860492 U 10/2014
KR 100738504 B1 7/2007
(Continued)

*Primary Examiner* — Alissa L Hoey

(57) ABSTRACT

Apparatus for a penis and a scrotum of a wearer are described. The apparatus may comprise a semi-rigid body and attachment element. The semi-rigid body may comprise a first structure sized to at least partially surround a posterior portion of the penis; a second structure positionable to maintain a separation between a posterior portion of the scrotum and thighs of the wearer; and third structure positionable to maintain a separation between an anterior portion of the scrotum and the penis when the second structure maintains the separation between the posterior portion of the scrotum and the thighs. The attachment element may be configured to maintain the semi-rigid body in a position relative to the wearer such that the second structure maintains the separation between the posterior portion of the scrotum and the thighs and the third structure maintains the separation between the anterior portion of the scrotum and the penis.

20 Claims, 14 Drawing Sheets

(56) References Cited

U.S. PATENT DOCUMENTS 4,776,325 A * 10/1988 Etingher ..... A61F 5/41 600/39
5,029,345 A 7/1991 Angheluta et al.
5,036,839 A 8/1991 Weiss et al.
5,070,869 A 12/1991 Zhang
5,074,853 A 12/1991 Bryant
5,094,234 A * 3/1992 Searcy ..... A61F 5/40 602/68
5,133,093 A 7/1992 Tsuchiya
5,157,793 A 10/1992 Michels
5,237,706 A 8/1993 Nalbandian
5,275,592 A * 1/1994 Grizzaffi ..... A61F 5/4401 2/403
5,283,912 A 2/1994 Chung
5,290,270 A * 3/1994 Fisher ..... A41B 9/02 2/403
5,314,447 A 5/1994 Papurt
5,524,298 A 6/1996 Plunkett
5,547,466 A 8/1996 McRoberts et al.
5,598,587 A 2/1997 Wada
5,647,065 A 7/1997 Richerson
5,807,299 A 9/1998 McRoberts et al.
6,061,840 A 5/2000 Alligator
6,245,036 B1 6/2001 McRoberts et al.
7,024,703 B1 * 4/2006 Della Ratta ..... A41B 9/023 2/400
7,578,296 B2 * 8/2009 Miller ..... A61F 5/0096 128/883
7,788,739 B1 * 9/2010 Della Ratta ..... A41B 9/023 2/400
7,958,571 B2 6/2011 Kitsch et al.
8,601,616 B2 12/2013 Radford et al.
9,393,151 B2 * 7/2016 Gallen ..... A61F 7/02
9,451,794 B2 * 9/2016 Lin ..... A41B 9/023
9,687,382 B2 * 6/2017 Beerman ..... A61F 5/40
9,924,746 B1 * 3/2018 Davis ..... A41B 9/023
2004/0094163 A1 5/2004 Benson
2004/0231034 A1 * 11/2004 Cym ..... A41B 9/023 2/403
2006/0211974 A1 * 9/2006 Bland ..... A61F 5/40 602/67
2007/0044209 A1 * 3/2007 Maurer ..... A41B 9/023 2/403
2007/0180600 A1 8/2007 Allemann et al.
2009/0113605 A1 * 5/2009 Nicolosi ..... A41B 9/023 2/403
2009/0288240 A1 * 11/2009 Lim ..... A41B 9/023 2/403
2012/0016189 A1 * 1/2012 Gioia ..... A61F 5/41 600/41
2012/0066817 A1 3/2012 Bell
2012/0197074 A1 * 8/2012 Basden ..... A61F 5/41 600/39
2012/0304364 A1 * 12/2012 Landi ..... A41B 9/12 2/403
2013/0117911 A1 * 5/2013 Nam ..... A41B 9/023 2/403
2013/0186150 A1 7/2013 Pilawa et al.
2013/0291879 A1 * 11/2013 Matsuda ..... A61F 2/0009 128/885
2013/0296645 A1 11/2013 Evans
2014/0073851 A1 * 3/2014 Gioia ..... A61H 1/02 600/38
2014/0189936 A1 * 7/2014 Lin ..... A61F 5/451 2/403
2014/0237704 A1 * 8/2014 Mehrabian ..... A41B 9/023 2/404
2015/0208732 A1 * 7/2015 Oh ..... A41B 9/001 2/403
2016/0157531 A1 * 6/2016 Fisher ..... A41D 1/088 2/403
2016/0278438 A1 * 9/2016 Polidan ..... A41B 9/001
2016/0286867 A1 10/2016 Blibech
2018/0028398 A1 * 2/2018 Ford, Sr. ..... A61H 19/44

FOREIGN PATENT DOCUMENTS

KR 20110095766 A 8/2011
WO WO-2009154385 A2 * 12/2009 ..... A61F 5/41
WO 2013172556 A1 11/2013

* cited by examiner

UNDERGARMENT SUPPORT APPARATUS AND SYSTEMS

BACKGROUND

1. Field

Aspects of the present disclosure generally relate to undergarment support apparatus and systems.

2. Description of Related Art

Many undergarments are unable to properly and comfortably support external genitalia, such as the penis, scrotum, and testicles. For example, it can be difficult for many fabric undergarments to comfortably support the male genitalia because the fabric naturally bunches and compresses when the wearer moves. Known options include undergarments providing a looser fit allowing for maximum genitalia movement, such as boxers; and undergarments providing a tighter fit with a pouch for the genitalia, such as a briefs. Neither of these solutions may be ideal for every man, particularly if his daily routine includes active movement conditions.

Many undergarments also fail to provide any form of impact protection. For example, most undergarments are made of thin fabrics that fail to provide any appreciable amount of impact protection, leaving the wearer vulnerable to injury. A jock strap with a protective cup may be worn. But these implements are often bulky and have limited sizing options, making them not suitable for everyday use, particularly for larger endowed and/or obese men.

Other genitalia-related products may have similar failings. For example, some non-undergarment products may be attached to the genitalia for erotic purposes without providing any appreciable degree of support or impact protection.

SUMMARY

Numerous aspects are described in this disclosure. One aspect is an apparatus for supporting a penis and a scrotum of a wearer. The apparatus may comprise a semi-rigid body, which may comprise: a first structure sized to at least partially surround a posterior portion of the penis; a second structure positionable to maintain a separation between a posterior portion of the scrotum and thighs of the wearer; and a third structure positionable to maintain a separation between an anterior portion of the scrotum and the penis when the second structure maintains the separation between the posterior portion of the scrotum and the thighs. The apparatus also may comprise an attachment element, which may be configured to maintain the semi-rigid body in a position relative to the wearer such that the second structure maintains the separation between the posterior portion of the scrotum and the thighs and the third structure maintains the separation between the anterior portion of the scrotum and the penis.

The semi-rigid body may comprise a silicone. The semi-rigid body may comprise, consist of, or consist essentially of a non-fabric material, a non-fibrous material, or a non-woven material. The attachment element may be removably attachable to the semi-rigid body. The apparatus may comprise a reinforcing element that is attachable to, embedded in, or formed integral with the first structure; and configured to resist deformations from forces applied to the semi-rigid body by the attachment element. The attachment element may be removably attachable to at least one of the first structure and the reinforcing element. The semi-rigid body may have a Young's modulus of at least 33 MPa.

A posterior face of the semi-rigid body may comprise an inlet opening sized to receive the penis in the first structure and the scrotum in the second structure, and at least a portion of the semi-rigid body adjacent the inlet opening may be removable to accommodate a size of the penis or the scrotum. The third structure may comprise a concave surface positionable below the penis when the second structure maintains the separation between the posterior portion of the scrotum and the thighs and the third structure maintains the separation between the anterior portion of the scrotum and penis, and at least a portion of the semi-rigid body adjacent the concave surface may be removable to accommodate a size of the penis. The first structure may define a protective hood and a conduit extending through the protective hood, and an interior diameter of the conduit may be sized to surround the posterior portion of the penis. The second structure may define a protective shell and a chamber inside the protective shell, and the chamber may be sized to at least partially surround the scrotum. A plurality of openings may extend into the chamber. The plurality of openings may comprise at least one of a ventilation opening, a flexibility-enhancing opening, and a drainage opening.

The apparatus may comprise a cover that is removably attachable to at least one of the semi-rigid body and the attachment element. The cover may comprise a layer of any type of fabric or fabric-like material. The cover may be impact absorbing. The cover may comprise a moisture retaining element configured to retain a predetermined amount of fluid. A portion of the moisture retaining element may be removably attachable to the semi-rigid body. The portion of the moisture retaining element may comprise at least one of an adhesive and an elastic element.

Another aspect is an apparatus for supporting a penis and a scrotum of a wearer. The apparatus may comprise a semi-rigid body, which may comprise: a means for at least partially surrounding the penis; and a means for at least partially surrounding the scrotum. The apparatus also may comprise an attachment means for maintaining a position of the semi-rigid body relative to the wearer. In some aspects, the body may comprise, consist of, or consist essentially of a non-fabric material, a non-fibrous material, or a non-woven material.

Additional apparatus and systems also are expressly or inherently described, along with various kits and methods related thereto.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are particularly described, pointed out, and taught in the written descriptions. Some structural and operational aspects may be even better understood by referencing the written portions together with the accompanying drawings, of which.

DETAILED DESCRIPTION

Figure 1:
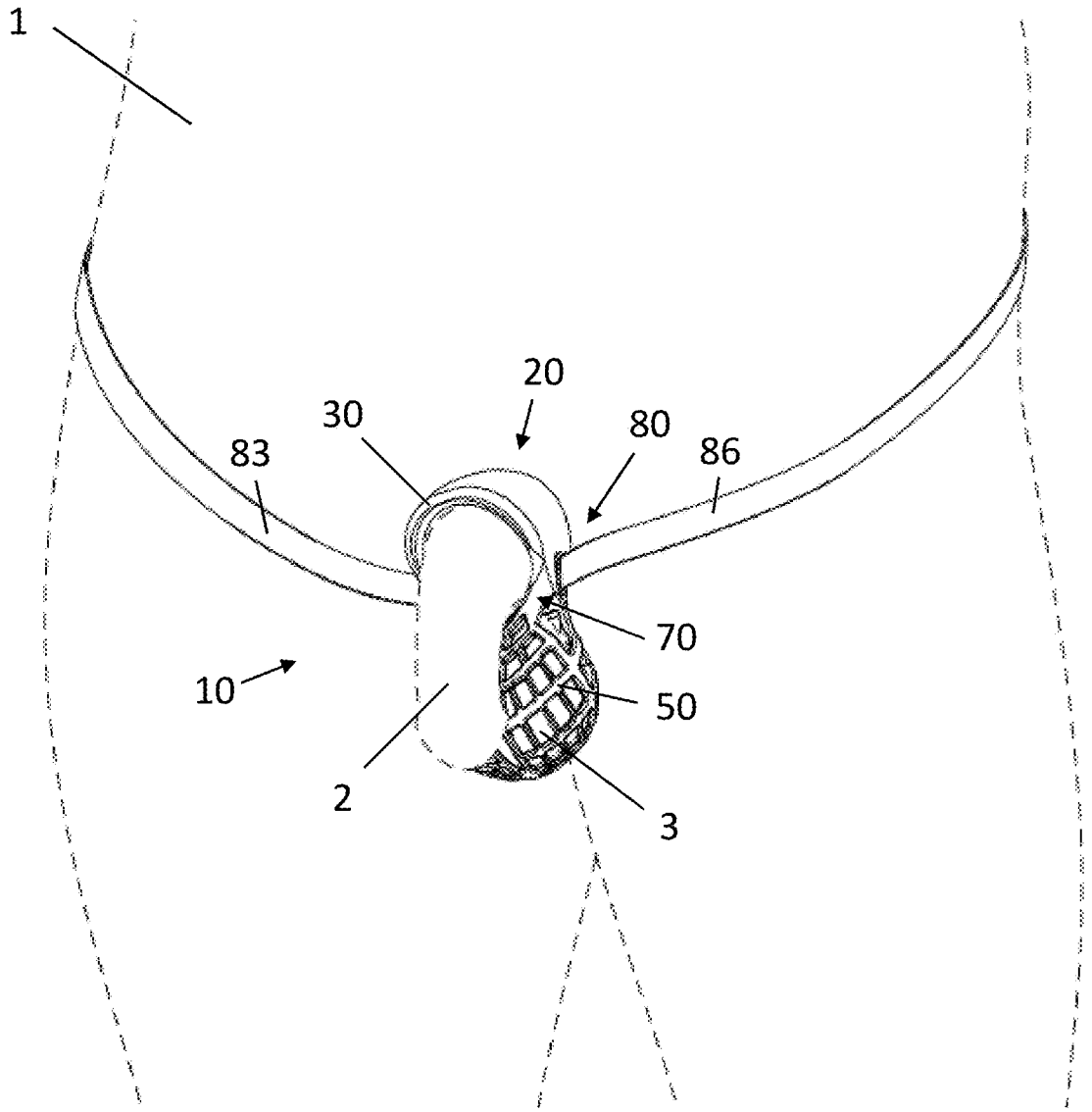
FIG. 1 depicts a perspective view of an exemplary support apparatus being worn by a wearer.

Aspects of the present disclosure are not limited to the exemplary structural details and component arrangements described in this description and shown in the accompanying drawings. Many aspects of this disclosure may be applicable to other aspects and/or capable of being practiced or carried out in various variants of use, including the examples described herein.

Throughout the written descriptions, specific details are set forth in order to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

Exemplary aspects of this disclosure reference undergarment support apparatus and systems. Some aspects are described with reference to particular structures (e.g., a body), materials (e.g., medical grade silicone), and attachment elements (e.g., straps) configured to support and protect particular body parts (e.g., the male genitalia). Unless claimed, these exemplary aspects are provided for convenience and not intended to limit the present disclosure. Accordingly, the concepts described in this disclosure may be utilized to support and protect any body part(s).

Several reference axes are described, including: a longitudinal axis X-X and a sagittal axis Y-Y. Some aspects are described relative to these axes. Each longitudinal axis X-X and sagittal axis Y-Y may define relative arrangements. For example, each longitudinal axis X-X may be non-parallel with at least one sagittal axis Y-Y in some perspectives, meaning that axis Y-Y may extend across and/or intersect axis X-X. The term "elongated" may describe any aspect having a length along one of axes X-X or Y-Y that is longer in relation to a width along a non-parallel one of axes X-X or Y-Y. Additional axes, movements, and forces also may be described with reference to axes X-X and Y-Y. These relative terms are provided for convenience and do not limit this disclosure unless claimed.

Anatomical terms such as "anterior" and "posterior" are used to orient some aspects relative to a wearer's body (e.g., a body of a human male). Anterior generally refers to a position toward a front the wearer and posterior generally refers to a position closer to a rear of the wearer. Additional anatomical terms also may be used. For example, longitudinal axis X-X may be oriented relative to a cranial-caudal axis of the wearer, and sagittal axis Y-Y may be oriented relative to an anterior-posterior axis of the wearer.

As used herein, inclusive terms such as "comprises," "comprising," "includes," "including," and variations thereof, are intended to cover a non-exclusive inclusion, such that an apparatus, method, system, or element thereof comprising a list of elements does not include only those elements, but may include other elements not expressly listed and/or inherent thereto. Unless stated otherwise, the term "exemplary" is used in the sense of "example," rather than "ideal," and does not limit this disclosure to any particular embodiment. Various terms of approximation may be used in this disclosure, including "approximately" and "generally." Unless stated otherwise, approximately means within 10% of a stated number or outcome and generally means "within most cases" or "usually."

As shown in FIG. 1, one exemplary aspect of this disclosure is a genitalia support apparatus 10 for a wearer 1 with a penis 2 and a scrotum 3. Support apparatus 10 may comprise a body 20 comprising a plurality of different structures that are formed together and/or attached to one another. For example, shown in FIG. 1, body 20 may comprise a first structure 30 for penis 2 and a second structure 50 for scrotum 3. In some aspects, body 20 also may comprise a third structure 70 positionable between the penis and the scrotum.

Over time, penis 2 and scrotum 3 may be subject to the pull of gravity much like the way a woman's breasts are. Women may wear a bra to correct the sagging effects of gravity by holding the breasts in a supported position. Unlike breasts, the size and shape of penis 2 and scrotum 3 may vary due to many factors, such as emotional state, movement conditions, temperature, and the like. Aspects of support apparatus 10 are configured to accommodate these changes. For example, first structure 30 may comprise a protective hood for penis 2 that accommodates changes in girth, allowing for free movement; and second structure 50 may comprise a protective shell for scrotum 3 that provides injury protections. As a further example, second structure 50 may be positionable to maintain a separation between a posterior portion of scrotum 3 and thighs of wearer 1; and third structure 70 may be positionable to maintain a separation between an anterior portion of scrotum 3 and penis 2 when second structure 50 maintains the separation between the posterior portion of scrotum 3 and the thighs, thereby preventing skin-on-skin contact between penis 2 and scrotum 3, and scrotum 3 and the thighs, resulting in a cool skin feel. As shown in FIG. 1, support apparatus 10 also may comprise an attachment element 80 that supports the weight of body 20, a weight of penis 2, and a weight of scrotum 3 from a waist of wearer 1, further countering the effects of gravity by transferring those weights to the waist (or other non-genitalia portion of wearer 1) while holding body 20 snug against wearer 1.

Figure 2:
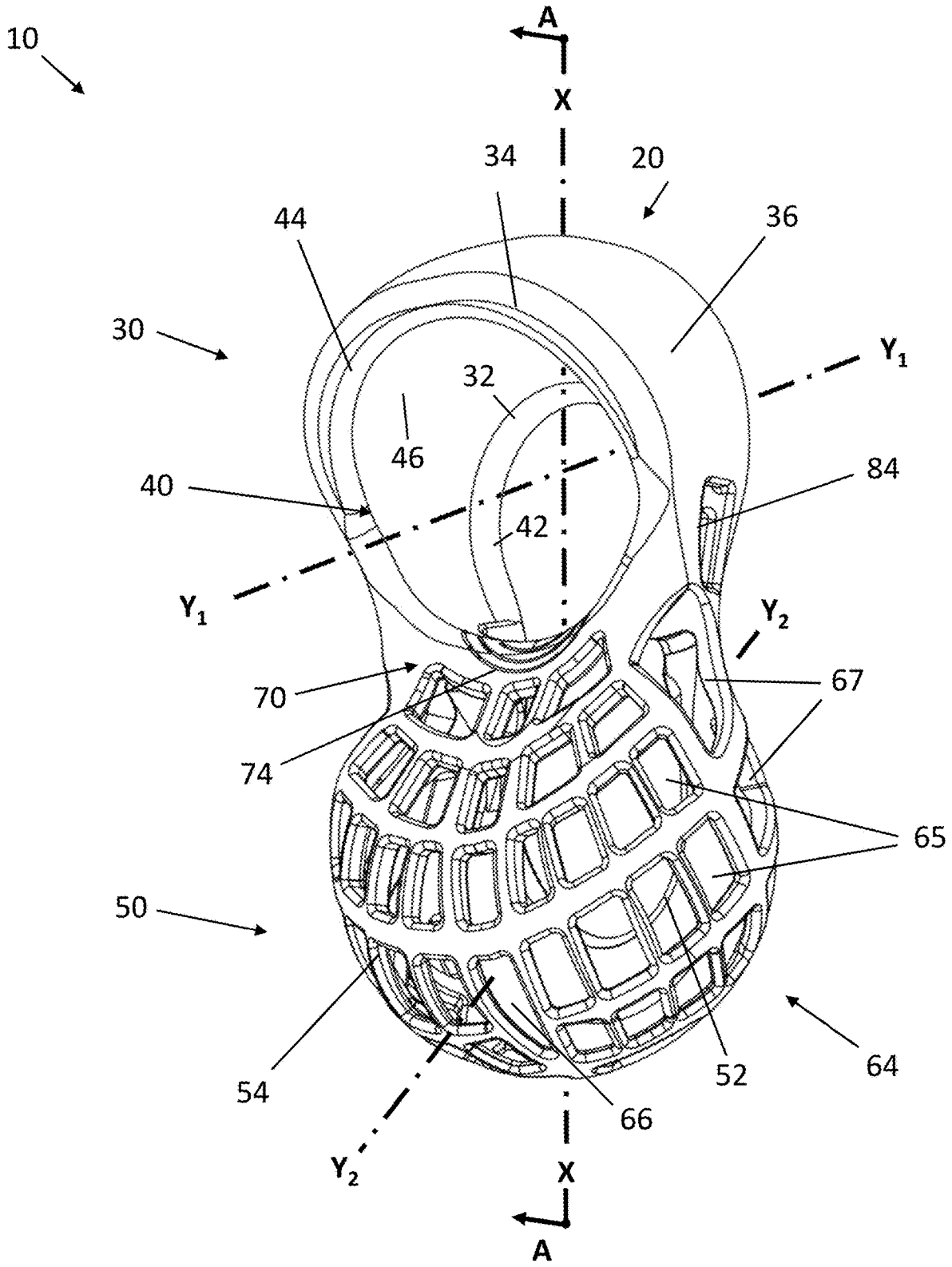
FIG. 2 depicts a perspective view of the FIG. 1 apparatus and indicates a section line A-A.
Figure 3:
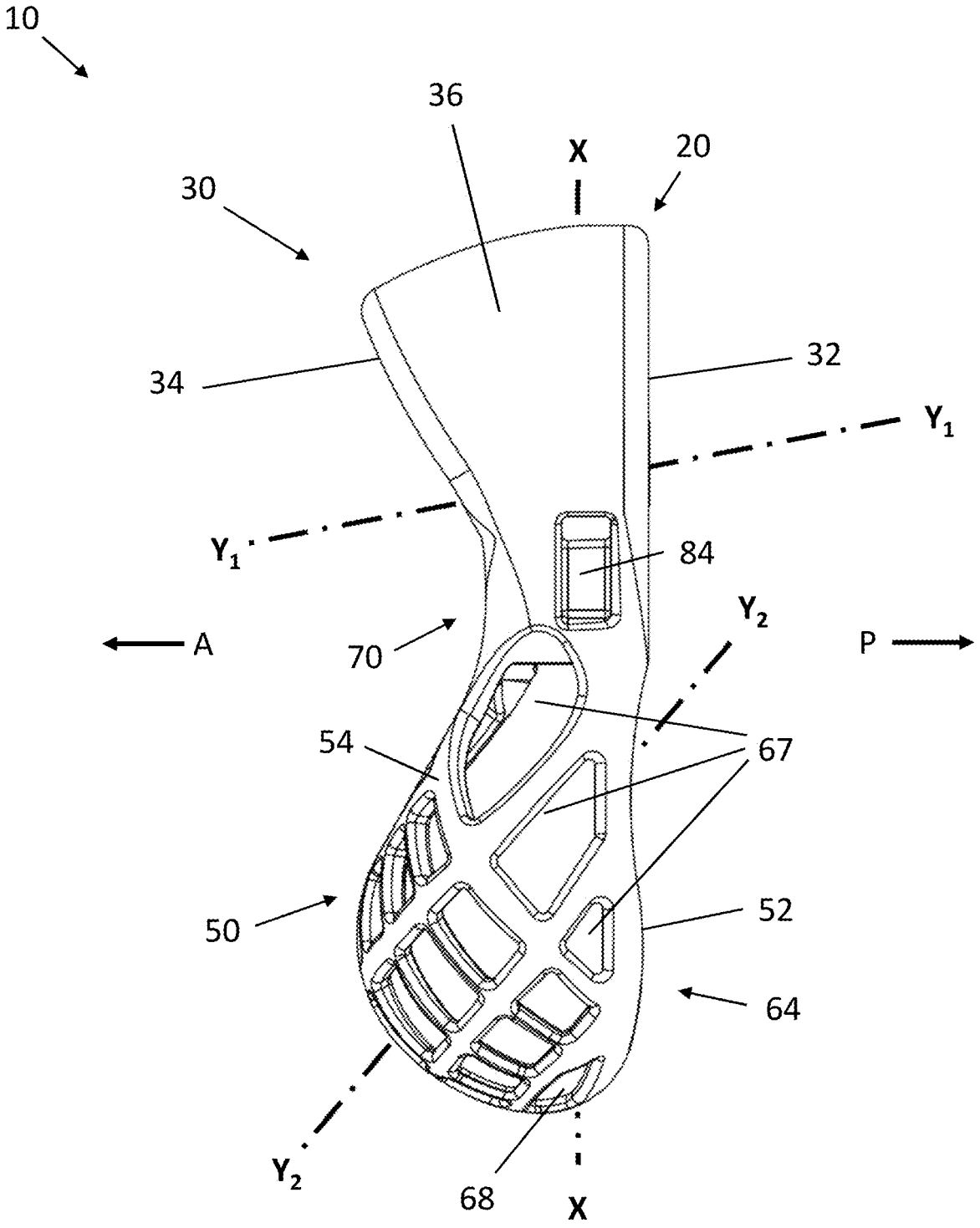
FIG. 3 depicts a side view of the FIG. 1 apparatus.
Figure 4:
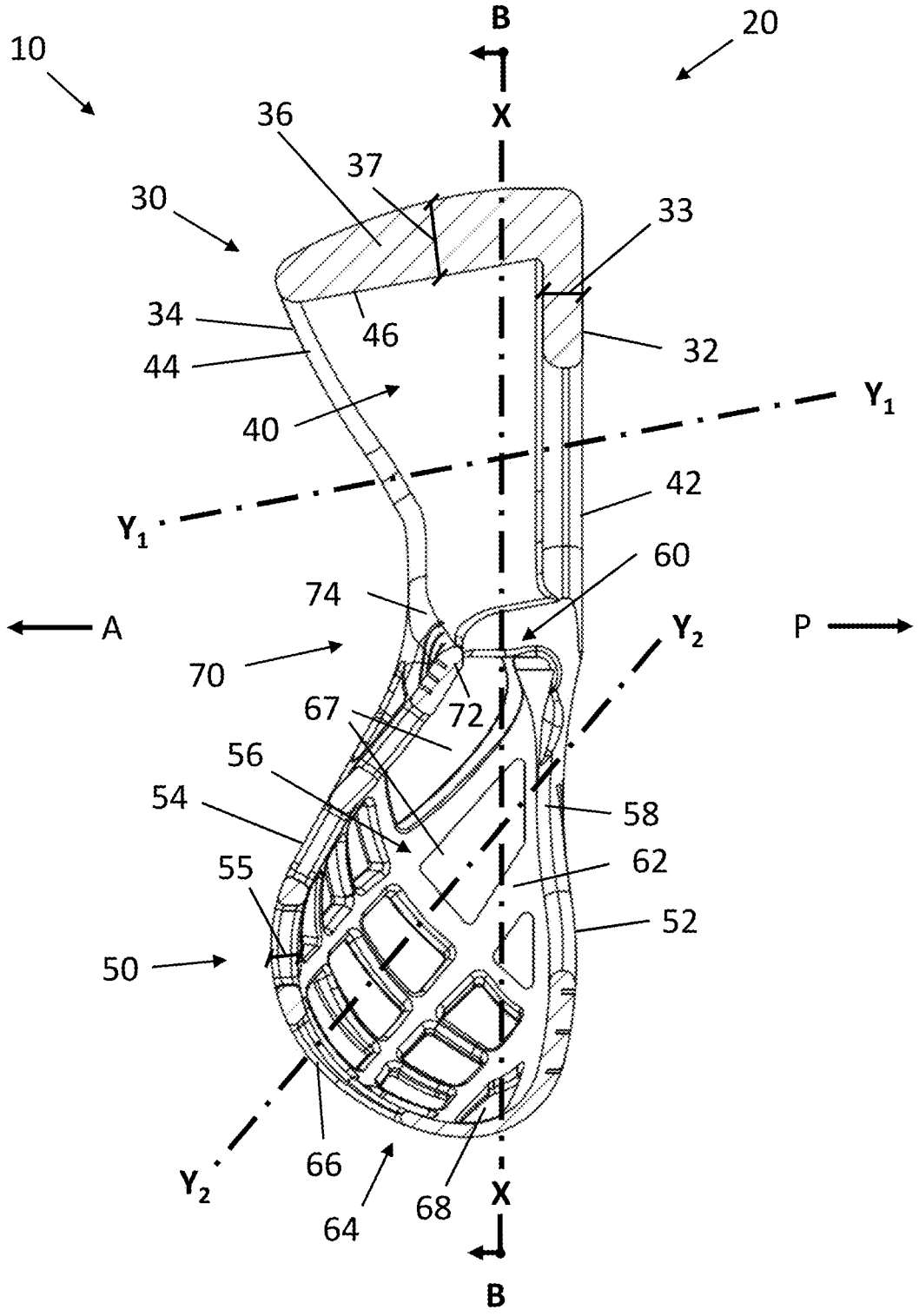
FIG. 4 depicts a cross-sectional side view of the FIG. 1 apparatus along section line A-A of FIG. 2, and indicates a section line B-B.

As shown in FIG. 2, body 20 may extend along a longitudinal axis X-X, first structure 30 may be located above second structure 50 along axis X-X, and third structure 70 may be located between structure 30 and structure 50. Body 20 may be worn by wearer 1 so that first structure 30 is oriented generally in a cranial direction (e.g., toward the head of wearer 1) and second structure 50 is oriented generally in a caudal direction (e.g., toward the feet of user 1). In some aspects, longitudinal axis X-X of FIG. 2 may be generally parallel with a cranial-caudal axis of wearer 1 when body 20 is worn. As shown in FIGS. 3 and 4, when worn, body 20 may comprise skin-facing exterior surfaces oriented generally in a posterior direction P (e.g., toward skin of wearer 1), and clothing-facing exterior surfaces oriented generally in an anterior direction A (e.g., away from the skin of wearer 1).

Body 20 may be a semi-rigid body having a flexural stiffness that is greater than traditional undergarment fabrics (e.g., greater than cotton and/or synthetic blends), but not inflexible. For example, body 20 may comprise a non-fabric or non-woven material, meaning that is not made of a cloth or cloth-like material produced by weaving or knitting textile fibers; and/or a non-fibrous material, meaning that it is not made of a material containing or resembling fibers, either of which may have a flexural stiffness comparable to that of silicone.

Body 20 also may be made from formable and/or flowable materials, including any materials that can be molded or printed using known methods, such as silicone. For example, body 20 may be unitarily formed from injection molding or 3D-printing and/or from coupling two or more separately formed bodies. As a further example, body 20 may be molded or 3D-printed from a silicone material in different generic sizes for penis 2 and scrotum 3, or mass-customized in particular sizes for penis 2 and scrotum 3 based on size and shape data for wearer 1 (e.g., a picture). Depending upon the material, portions of body 20 also may be removed (e.g., cut-away) to provide a more custom fit around penis 2 and/or scrotum 3.

In each of these examples, body 20 may comprise any material(s) having a Young's modulus that is greater than traditional undergarment fabrics (e.g., greater than cotton and/or synthetic blends) and/or equivalent to the Young's modulus of silicone. For example, body 20 may have a Young's modulus that is: greater than 5 MPa; between approximately 5 MPa and approximately 20 MPa; between approximately 20 MPa and approximately 40 MPa; at least 33 MPa; between approximately 33 MPa and approximately 50 MPa; or 40 MPa or greater.

Body 20 may comprise any combination of one or more of such materials, homogeneous or heterogeneous. For example, first and second structures 30 and 50 of body 20 may be made of a flexible biocompatible material, such as a flexible polymeric material, like medical grade silicone. Depending on their flexural stiffness, such materials may deflect when body 20 is worn. Body 20 may limit such deflections. For example, a material composition, shape, and/or thickness of body 20 may be configured to limit such deflections in one or more directions.

First structure 30 may at least partially surround a posterior portion of penis 2 (e.g., a base of penis 2). As shown in FIG. 2, first structure 30 may comprise a posterior face 32, an anterior face 34, and a protective hood 36 extending between face 32 and face 34. As shown in FIGS. 3 and 4, for example, posterior face 32 may be generally parallel with longitudinal axis X-X, anterior face 34 may be generally non-parallel with axis X-X, and protective hood 36 may extend along a sagittal axis $Y_1$-$Y_1$ that is generally non-parallel with posterior face 32 and axis X-X. For example, an angle between longitudinal axis X-X and sagittal axis $Y_1$-$Y_1$ may be relative to an angle between a cranial-caudal axis of wearer 1 and penis 2 when flaccid; or a range of angles between the cranial-caudal axis of wearer 1 and penis 2 when flaccid or erect.

Figure 14:
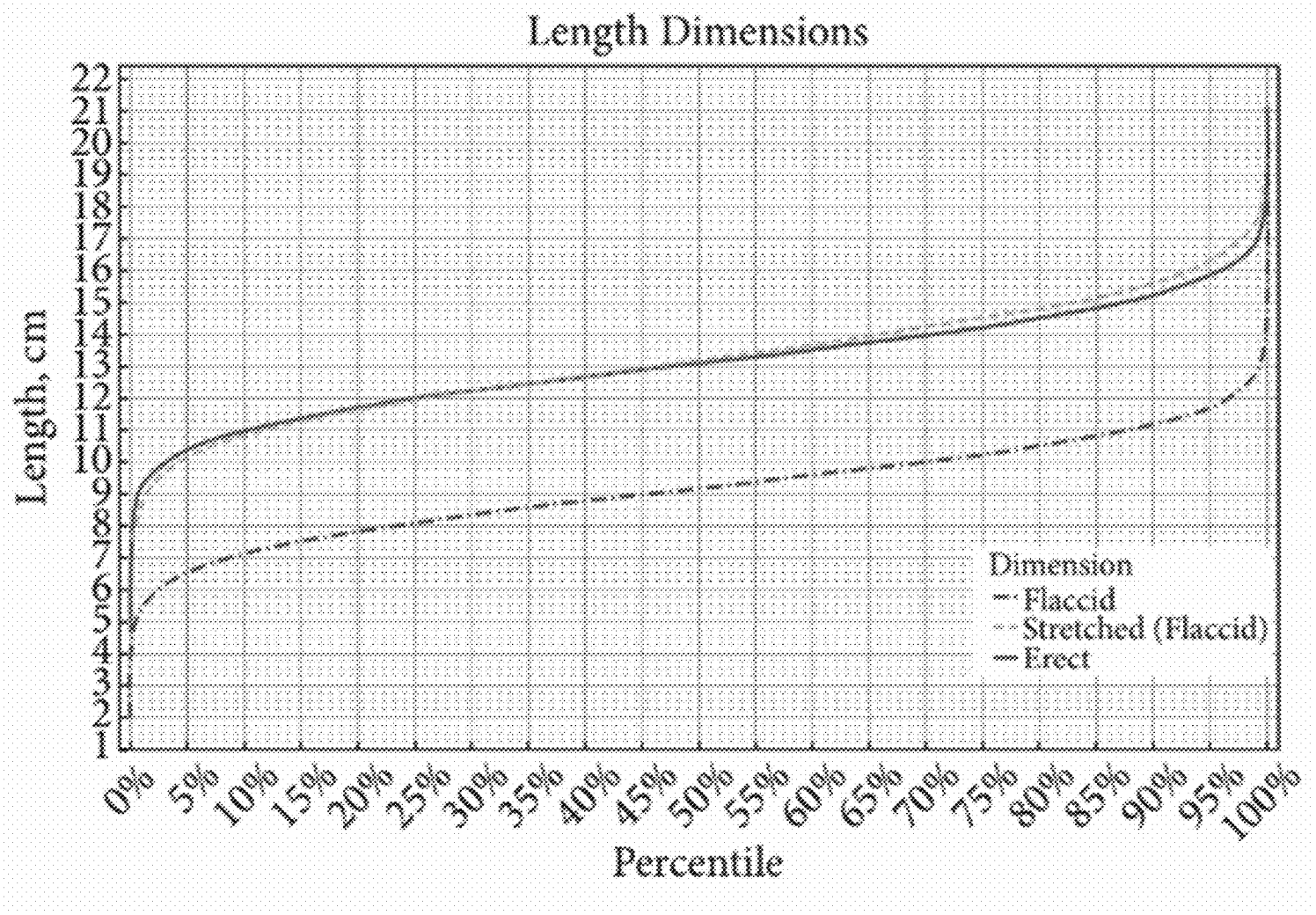
FIG. 14 depicts an exemplary chart of penis size.

To provide compression free movement of penis 2, protective hood 36 may be sized to "tent" any clothing over penis 2. As shown in FIG. 14, a length of penis 2 when flaccid for 90% of men is between approximately 6.5 cm. (or approximately 2.5 inches) and 11.5 cm (or approximately 4.5 inches), meaning that a length of protective hood 36 along sagittal axis $Y_1$-$Y_1$ may be between approximately 2.5 cm (or approximately 1 in) and approximately 10 cm (or approximately 4 in), or between approximately 5 cm (or approximately 2 in) and approximately 9 cm (or approximately 3.5 in), to accommodate and/or sufficient tent over most penis sizes in a flaccid state with little to no compression from clothing or underwear. Other sizes may be used. For smaller endowed men, the exemplary dimensions may be sufficient to avoid or eliminate "turtling," which occurs when penis 2 retracts into the abdomen when sitting or crouching. Larger sizes may be used to accommodate larger endowed men, as needed.

Figure 5:
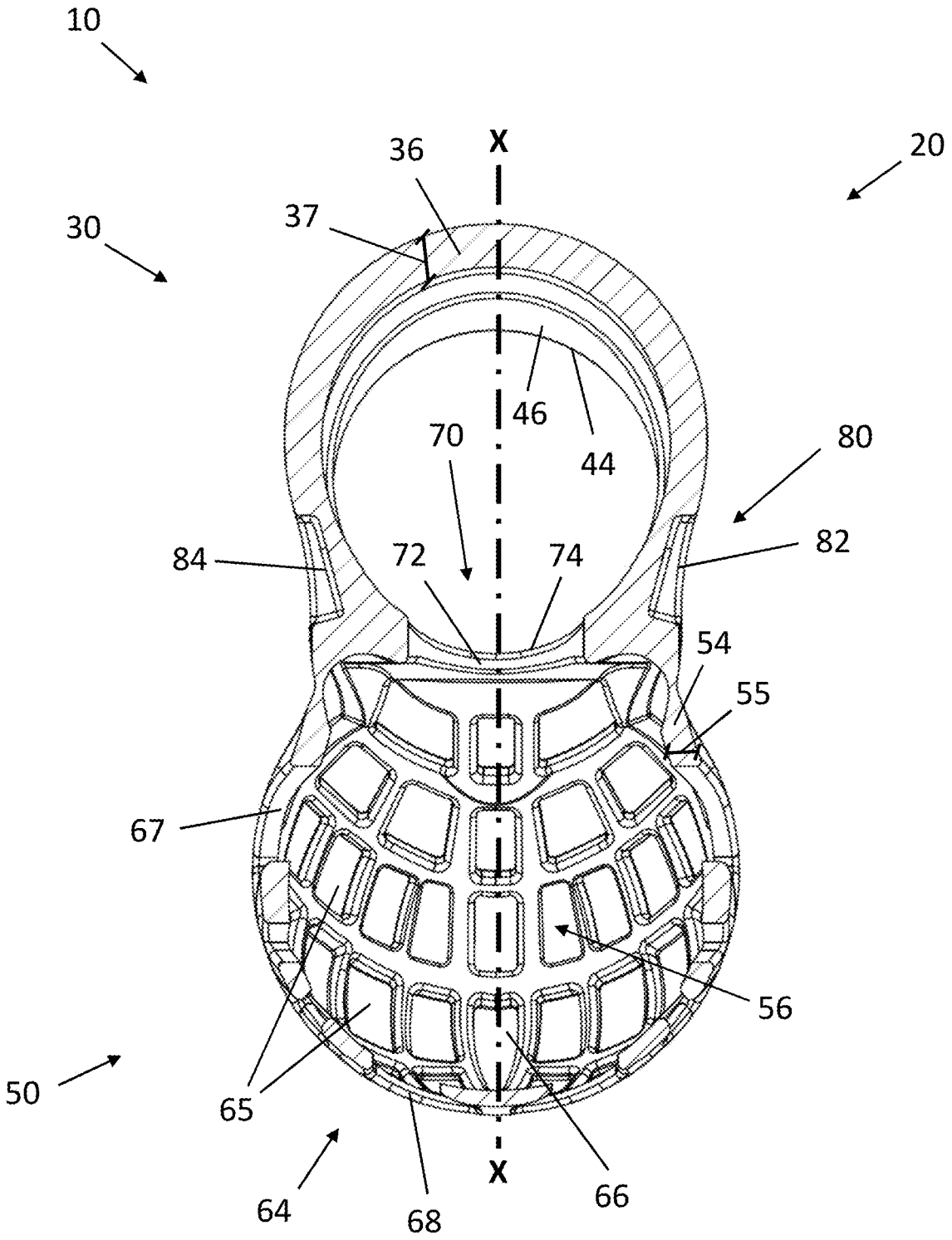
FIG. 5 depicts a cross-sectional back view of the FIG. 1 apparatus along section line B-B of FIG. 4.

Exterior surfaces of protective hood 36 may define a cylindrical shape extending along sagittal axis $Y_1$-$Y_1$ to surround and/or protect penis 2. As shown in FIGS. 3 and 4, the cylindrical shape may curve relative to sagittal axis $Y_1$-$Y_1$ and/or have rounded edges at faces 32 and 34. Protective hood 36 may be configured to support and stabilize body 20. As shown in FIGS. 4 and 5, the material composition of protective hood 36, a curvature of its cylindrical shape, a wall thickness 33 of posterior face 32, and/or a wall thickness 37 of protective hood 36 may be configured to support and stabilize body 20 by increasing the rigidity of first structure 30. For example, wall thickness 33 may be between approximately 1 mm (or approximately 0.04 inches) and approximately 8 mm (or approximately 0.31 inches). The increased rigidity may help to maintain a shape of body 20 when worn by limiting deflections caused by forces applied thereto by wearer 1 or their clothing, such as lateral forces $F_1$ and $F_2$ shown in FIG. 8. In some aspects, protective hood 36 may be rigid enough to resist forces applied by clothing or other impacts, yet flexible enough to allow movements of penis 2. For example, a lateral strength of protective hood 36 without any additional reinforcing elements may be strong enough to resist deflections (e.g., from lateral forces $F_1$ and $F_2$) without placing any hard surfaces in contact with penis 2 or scrotum 3.

Interior surfaces of protective hood 36 may define a conduit 40 extending through body 20 along sagittal axis $Y_1$-$Y_1$. As shown in FIGS. 3 and 4, conduit 40 may be defined by a plurality of interior surfaces that are oriented relative to and/or generally centered on sagittal axis $Y_1$-$Y_1$. For example, conduit 40 may extend between: an inlet opening 42 extending through posterior face 32; an outlet opening 44 extending through anterior face 34; and conduit-defining surfaces 46 extending between openings 42 and 44. The relative shapes and sizes of inlet opening 42, outlet opening 44, and surfaces 46 may vary. As shown in FIG. 4, a size of inlet opening 42 may be different (e.g., larger) than a size of outlet opening 44; and a shape of conduit-defining surfaces 46 may vary along sagittal axis $Y_1$-$Y_1$ to accommodate the different sizes of openings 42 and 44.

Inlet opening 42 may be sized to receive penis 2. For example, inlet opening 42 of FIG. 4 may comprise a first diameter at posterior face 32 that is sized to receive a posterior portion of penis 2 (e.g., the base), outlet opening 44 may comprise a second diameter at anterior face 34 that is sized to receive an anterior portion (e.g., the shaft) of penis 2, and the second diameter may be larger than the first diameter. As a further example, at least upper portions of conduit-defining surfaces 46 may taper along sagittal axis $Y_1$-$Y_1$ between inlet opening 42 and outlet opening 44. As shown in FIG. 4, wall thickness 37 of protective hood 36 may be generally uniform in some areas, such that a curvature of conduit-defining surfaces 46 about sagittal axis $Y_1$-$Y_1$ may be defined by a curvature of protective hood 36 about sagittal axis $Y_1$-$Y_1$. In some aspects, a portion of body 20 adjacent inlet opening 42 may be adjustable for different girth (e.g., by removing portions of posterior face 32), yet still able to separate penis 2 from scrotum 3.

Posterior face 32 may extend downward from protective hood 36 to contact a portion of penis 2. As shown in FIG. 4, inlet opening 42 may comprise rounded edges that may contact penis 2 when flaccid or erect. Outlet opening 44 also may contact a portion of penis 2. As also shown in FIG. 4, for example, outlet opening 44 may comprise rounded edges configured to maintain contact with penis 2 when erect, and wall thickness 37 of protective hood 36 may be configured to limit deformations of body 20 caused by the erection.

Second structure 50 may define a protective shell configured to envelop scrotum 3 by at least partially surrounding anterior and posterior portions thereof. In some aspects, second structure 50 may be strong enough to support scrotum 3 without compression, yet light enough to ensure comfort. For example, second structure 50 may be described as a non-compressive, semi-spherical cage that at least partially surrounds anterior and posterior portions of scrotum 3 when body 20 is worn and/or provides a support frame for other objects, such cover 210 described below.

As shown in FIG. 2, second structure 50 may comprise a posterior face 52 and an anterior face 54 extending outwardly from posterior face 52. As shown in FIGS. 3 and 4, posterior face 52 may be generally parallel with longitudinal axis X-X, and anterior face 54 may comprise a curved shape extending from posterior face 52 along a sagittal axis $Y_2$-$Y_2$ that is generally non-parallel with anterior face 54, longitudinal axis X-X, and/or sagittal axis $Y_1$-$Y_1$ of first structure 30. As shown particularly in FIG. 2, the curved shape of anterior face 54 may comprise one or more semi-spherical or pear-like shapes that extend along and/or are oriented relative to axes X-X and/or $Y_2$-$Y_2$. For example, the curvature of anterior face 54 may be defined relative to an exterior size and/or shape of scrotum 3, and include any regular or irregular shapes.

Interior surfaces of posterior face 52 and anterior face 54 may define a chamber 56 (e.g. FIG. 4) configured to contain and/or protect scrotum 3. As shown in FIG. 4, for example, chamber 56 may extend between: an inlet opening 58 extending through posterior face 52; a chamber opening 60 in communication with conduit 40 of first structure 30; and chamber-defining surfaces 62 connecting inlet opening 58 and chamber opening 60.

Figure 6:
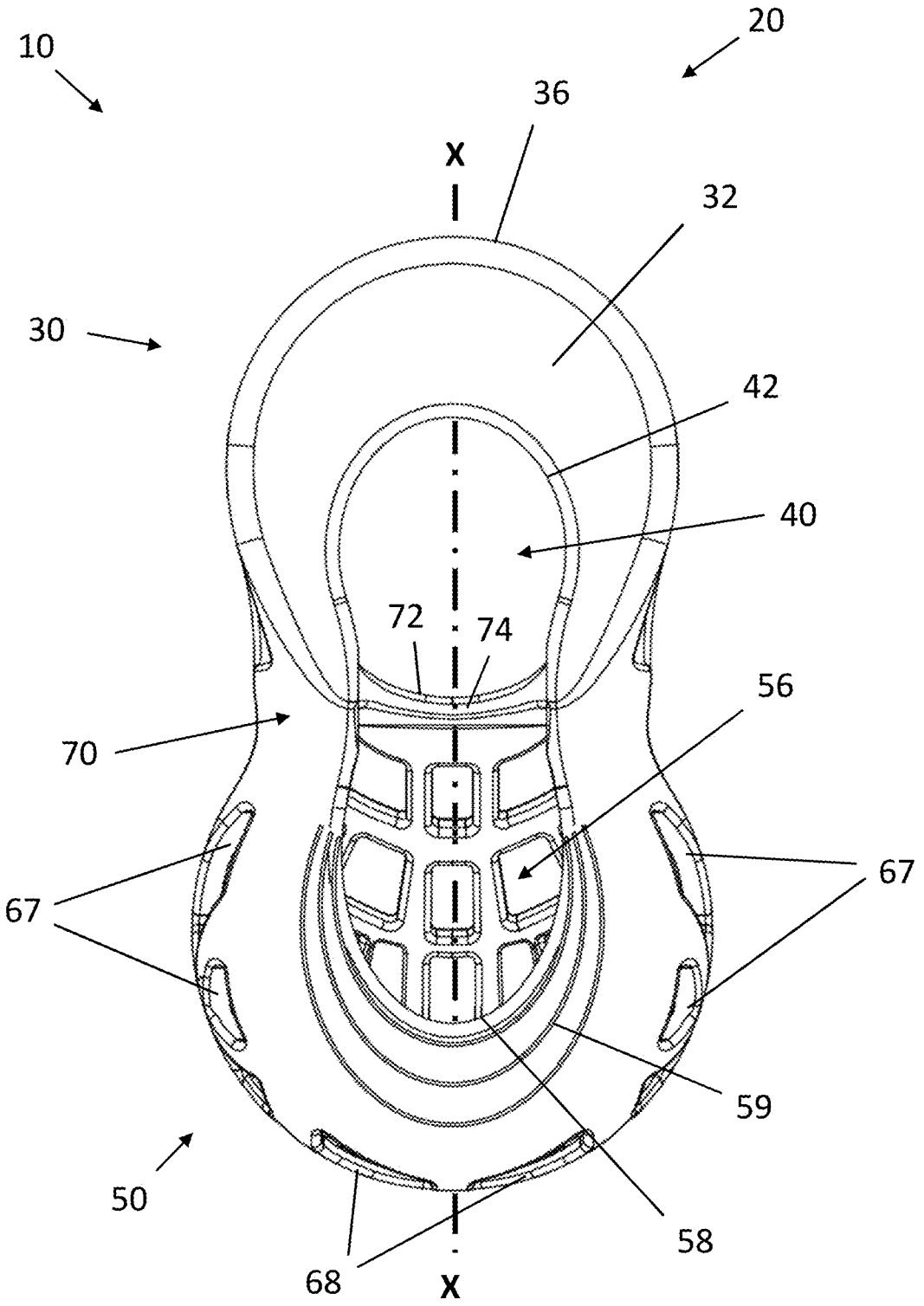
FIG. 6 depicts a back view of the FIG. 1 apparatus.
Figure 7:
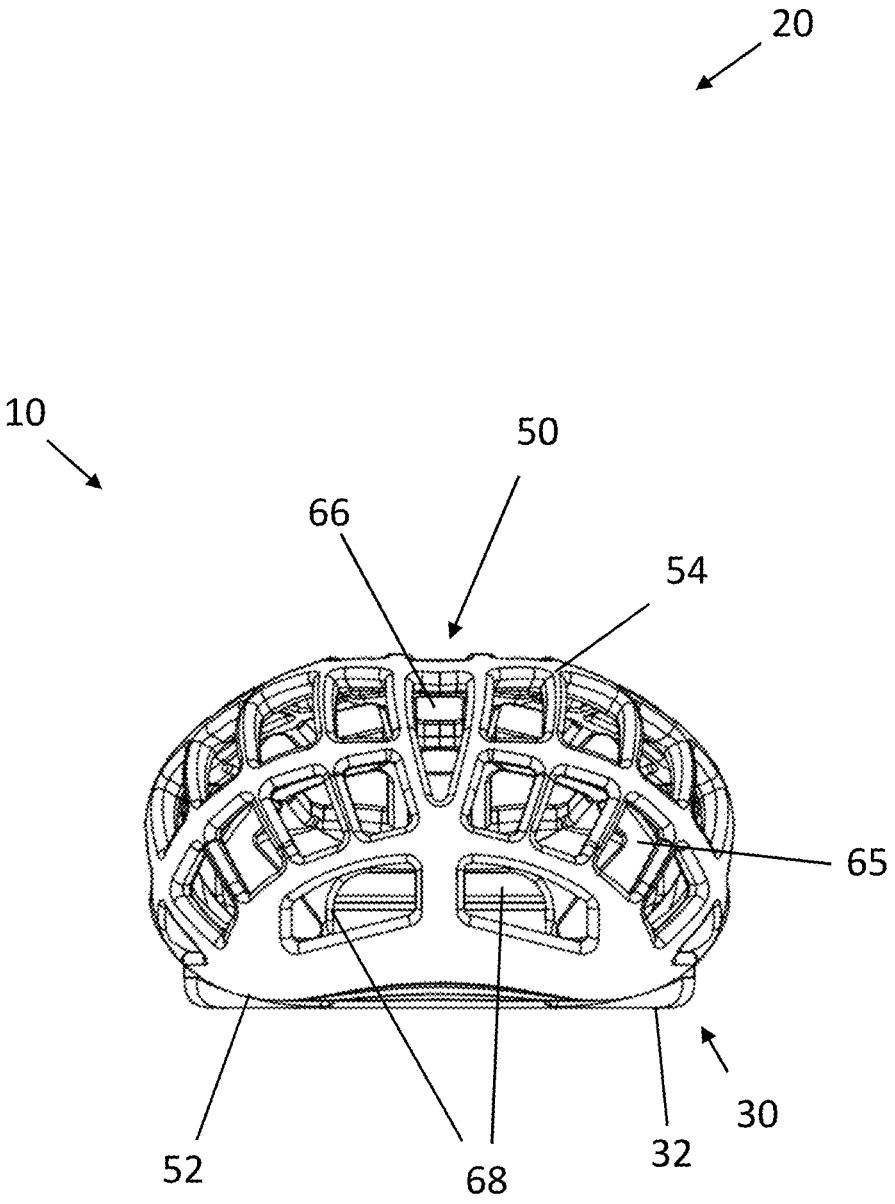
FIG. 7 depicts a bottom view of the FIG. 1 apparatus.

Inlet opening 58 may be sized to receive scrotum 3. As shown in FIG. 6, inlet opening 42 of conduit 40 and inlet opening 58 of chamber 56 may be merged to define a single inlet opening for penis 2 and scrotum 3. Inlet opening 42 may define an upper diameter of the single opening, inlet opening 58 may define a lower diameter of the single opening, and the single opening may comprise a shape defined by intersections of the upper and lower diameters, such as a hippopede. The shape may correspond with the natural shape of penis 2 and scrotum 3. As also shown in FIG. 6, inlet opening 58 may comprise an entry 59 that flexes to receive and capture scrotum 3. For example, entry 59 may be flexed in anterior direction A when receiving scrotum 3 into chamber 56, and then flexed in posterior direction P behind scrotum 3 to capture it within chamber 56. Portions of entry 59 may be removed (e.g., cut-away) to adjust the size of inlet opening 58.

Chamber opening 60 (e.g., FIG. 4) may comprise any shape that places conduit 40 in communication with chamber 56. As shown in FIG. 4, first structure 30 may taper towards chamber opening 60 in a caudal direction along body axis X-X, second structure 50 may taper toward chamber opening 60 in a cranial direction along axis X-X, and chamber opening 60 may comprise an irregular shape extending between structures 30 and 50. A shape of chamber-defining surfaces 62 also may be defined relative to an exterior size and/or shape of scrotum 3, and thus, like anterior face 54, many include any combination or regular or irregular shapes. As shown in FIG. 4, a wall thickness 55 of anterior face 54 may be generally uniform in some areas, such that a curvature of chamber-defining surfaces 62 about sagittal axis $Y_2$-$Y_2$ may be defined by a curvature of anterior face 54 about axis $Y_2$-$Y_2$. For example, wall thickness 55 may be between approximately 1 mm (or approximately 0.04 inches) and approximately 8 mm (or approximately 0.31 inches).

Second structure 50 may be ventilated to provide non-pinching support for scrotum 3. As shown in FIGS. 1-8, second structure 50 may comprise a plurality of openings 64 extending through anterior face 54 and conduit-surfaces 62 (FIG. 4) to chamber 56 at spaced apart locations. Each opening 64 may be sized and positioned to perform a different function. For example, plurality of openings 64 may comprise: (i) openings 65 that are oriented in radial patterns on anterior face 54 (e.g., FIG. 2) and configured to ventilate chamber 56; (ii) at least one opening 66 that extends down a center of anterior face 54 (e.g., FIG. 2) and is configured to promote lateral flexibility between left and right portions of second structure 50; (iii) openings 67 that are located on each side of second structure 50 (e.g., FIG. 2), and configured to promote vertical flexibility between first structure 30 and second structure 50; and (iv) openings 68 that are located on the bottom of second structure 50 (e.g., FIG. 7), and configured to drain fluids from chamber 56. Any shape, size, and position of openings may be used to perform these functions, including these examples.

Each opening 64 may modify the rigidity of second structure 50. For example, wall thickness 55 of anterior face 54 (e.g., FIG. 4) and/or plurality of openings 64 may be configured to maintain the shape of second structure 50 and/or limit deflections of the shape caused by movements of wearer 1. As a further example, the material composition of body 20, the thickness 55 of face 54, and/or the size and location of openings 64 may be configured to absorb or deflect a portion of any compression and/or impact forces applied to scrotum 3 during the movements, helping to prevent injuries to scrotum 3 and/or the testes contained therein.

Accordingly, wearer 1 may wear body 20 by guiding penis 2 into inlet opening 42 of first structure 30 and scrotum 3 into inlet opening 52 of second structure 50 so that openings 42 and 52 fit snugly around penis 2 and scrotum 3, the posterior portion of penis 2 is surrounded by conduit 40, the anterior portion of penis 2 extends through outlet opening 44, and anterior and posterior portions of scrotum 3 are surrounded by chamber 56.

Third structure 70 may comprise one or more surfaces or structures that are positionable between penis 2 and scrotum 3 when body 20 is worn. As shown in FIG. 4, for example, third structure 70 may comprise a dividing surface 72 that extends between conduit 40 and chamber 56, and may be located adjacent the posterior portion of penis 2 and a upper anterior portion of scrotum 3 when body 20 is worn. For example, dividing surface 72 may comprise a wedge shape and/or rounded edges positionable to maximize comfort when maintained against soft tissues of penis 2 and scrotum 3.

Put another way, second structure 50 may be positionable to maintain a separation between a posterior portion of scrotum 3 and thighs of wearer 1; and third structure 70 may be positionable to maintain a separation between an anterior portion of scrotum 3 and penis 1 when second structure 50 maintains the separation between the posterior portion of scrotum 3 and the thighs.

Third structure 70 also may maintain an alignment of penis 2 relative to scrotum 3 to allow for easy access and voiding. As shown in FIG. 2, third structure 70 may comprise an alignment surface 74 configured to align penis 2 generally with a centerline of anterior face 54. Alignment surface 74 may comprise a concave portion of anterior face 54 that is generally aligned with longitudinal axis X-X and/or curved to accommodate a diameter of the underside of penis 2. For example, the curvature of alignment surface 74 may help to center penis 2 relative to scrotum 3 when wearer 1 is resting, and return penis 2 to center if moved off of center when wearer 1 is moving. As shown in FIG. 2, alignment surface 74 also may comprise one or more grooves or openings configured to minimize contacts with penis 2 and promote additional airflows around penis 2. The grooves or openings of alignment surface 74 also may permit adjustment of body 20 to accommodate different sizes of penis 2. For example, the grooves or openings may allow portions of alignment surface 74 to be removed (e.g., cut-away) to achieve a desired fit with penis 2 or scrotum 3. As further example, any removable portions of body 20 described herein may comprises similar grooves, openings, or other scoring means.

Penis 2 may naturally retreat toward wearer 1 when sitting or bending over, and expand away from wearer 1 when standing. Third structure 70 may accommodate this motion by allowing first structure 30 to flex toward second structure 50 and vice versa. Other structures of body 20 may help with the flexing, such as openings 67. This flexibility means that, through daily movements, penis 2 is free to ease from a retracted position to an expanded position within conduit 40. In some aspects, the flexibility also may decrease turtling.

As shown in FIG. 1, attachment element 80 may be configured to maintain body 20 in a position relative to wearer 1 such that second structure 50 maintains the separation between the posterior portion of scrotum 3 and the thighs and third structure 70 maintains the separation between the anterior portion of scrotum 3 and penis 2. Attachment element 80 may suspend a weight of body 20 and a weight of the genitalia from wearer 1, and maintain a snug fit between body 20 and wearer 1. For example, attachment element 80 may suspend the weights of body 20 and the genitalia from the waist of wearer 1 in order to reduce the amount of weight supported by the genitalia; and maintain one or both of posterior surfaces 32 and 52 against anterior portions of wearer 1 so as to limit movements of body 20.

As shown in FIG. 1, attachment element 80 may comprise one or more straps engageable with body 20. For example, the straps may be configured to travel up the "V" of the lower abdomen and around the small of the back to free wearer 1 from posterior straps and/or fabrics. Aspects of the straps may have elastic characteristics and/or otherwise be configured to maintain posterior surfaces 32 and/or 52 against the anterior portions of wearer 1.

Figure 8:
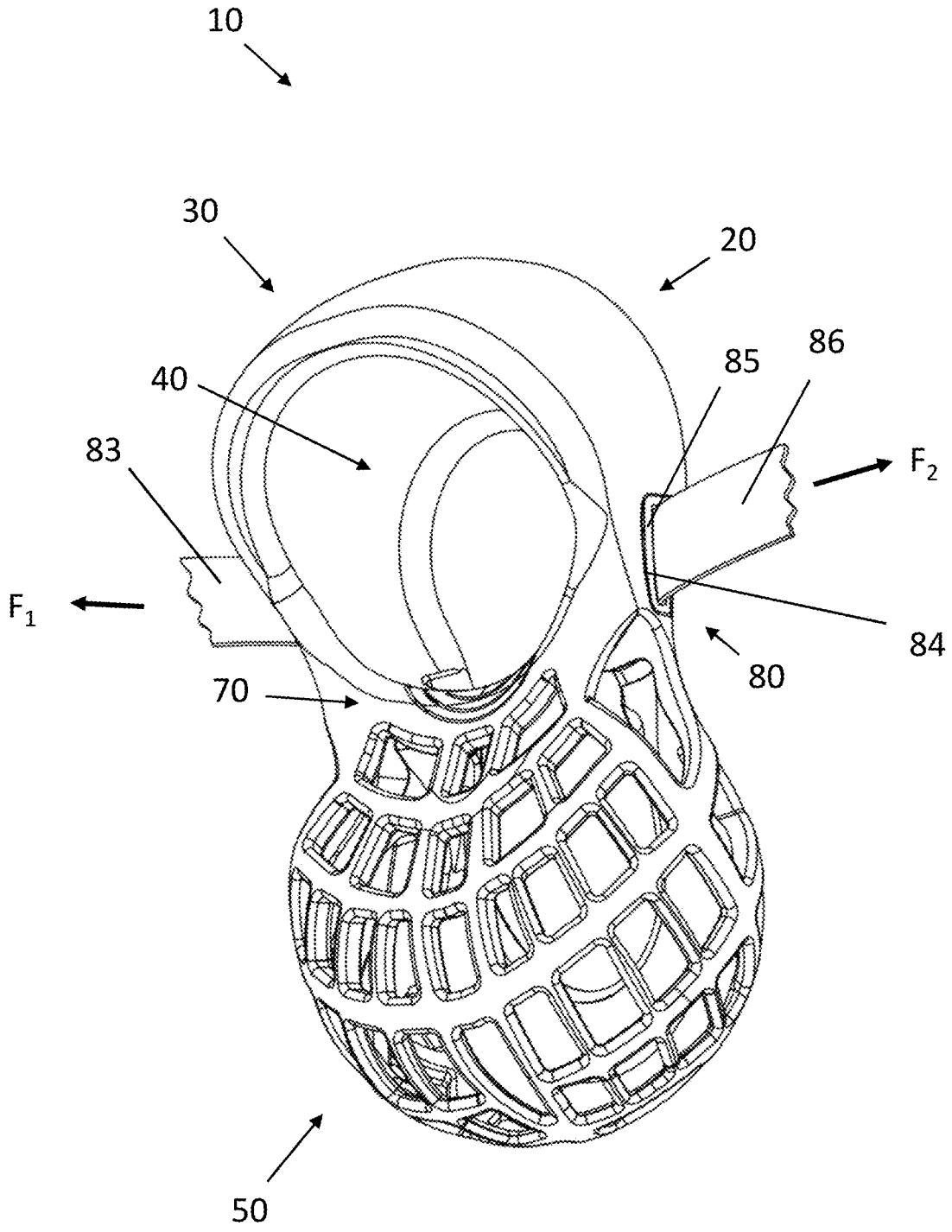
FIG. 8 depicts the FIG. 1 apparatus and exemplary attachment elements.

The straps may be removably attachable to body 20. As shown in FIG. 5, for example, attachment element 80 may comprise a first attachment opening 82 on one side of body 20 and a second attachment opening 84 on the other side of body 20. As shown in FIGS. 1 and 8, attachment element 80 also may comprise a first strap portion 83 comprising a first end connector (not visible in FIG. 5) engageable with first attachment opening 82; and a second strap portion 86 comprising a second end connector 85 engageable with second attachment opening 84. For example, each attachment opening 82 and 84 may comprise a shape; and each end connector of strap portions 83 and 86 (e.g., such as connector 85 of FIG. 8) may comprise a corresponding shape engageable with the shape of attachment openings 82 and 84 to removably attach strap portions 83 and 86 to body 20. Any interlocking shapes and/or structures may be used.

As shown in FIG. 1, first and second strap portions 83 and 86 may be attached to one another and configured to wrap around the waist of wearer 1, thereby transferring weight to a waist of wearer 1. Strap portions 83 and 86 also may be attached to another portion and/or garment of wearer 1. For example, strap portions 83 and 86 also may comprise additional connectors or surfaces that are engageable with adjacent portions of skin (e.g., via a biocompatible adhesive) and/or other garments (e.g., such as another undergarment or belt) of wearer 1 by any known means. As a further example, strap portions 83 and 86 may be attachable to a form fitting undergarment without the use of a belt.

However configured, attachment element 80 may apply vertical and/or lateral forces to body 20 when worn. Aspects of body 20 may be configured to limit deflections caused by those forces. As shown in FIG. 8, exemplary forces may comprise first lateral force $F_1$ applied to attachment opening 82 by first strap portion 83 and second lateral force $F_2$ applied to attachment opening 84 by second strap portion 86. As shown in FIG. 5, attachment openings 82 and 84 may be located in first structure 30; and first structure 30 may be configured to maintain the shape of body 20 by resisting forces $F_1$ and $F_2$. For example, the cylindrical shape of protective hood 36 may comprise a semi-circular cross-section extending between attachment openings 82 and 84; and any one or more of a diameter of the semi-circular cross-section, the material composition of first structure 30, and/or wall thickness 37 of protective hood 36 may be configured to limit deflections of the semi-circular shape caused by lateral forces $F_1$ and $F_2$ when body 20 is worn.

Additional aspects of this disclosure are now described with reference to FIGS. 9-11 with reference to a genitalia support apparatus 110. Particular differences between apparatus 110 and 10 are described. Other aspects of support apparatus 110 may be similar or identical to counterpart aspects of support apparatus 10, but within the 100 series of numbers, whether or not those aspects are expressly described herein or marked on FIGS. 9-11. Without limitation, any aspects described with reference to genitalia support apparatus 110 may be applicable to any variation of support apparatus 10 described herein and vice versa, each possible iteration being part of this disclosure.

Figure 9:
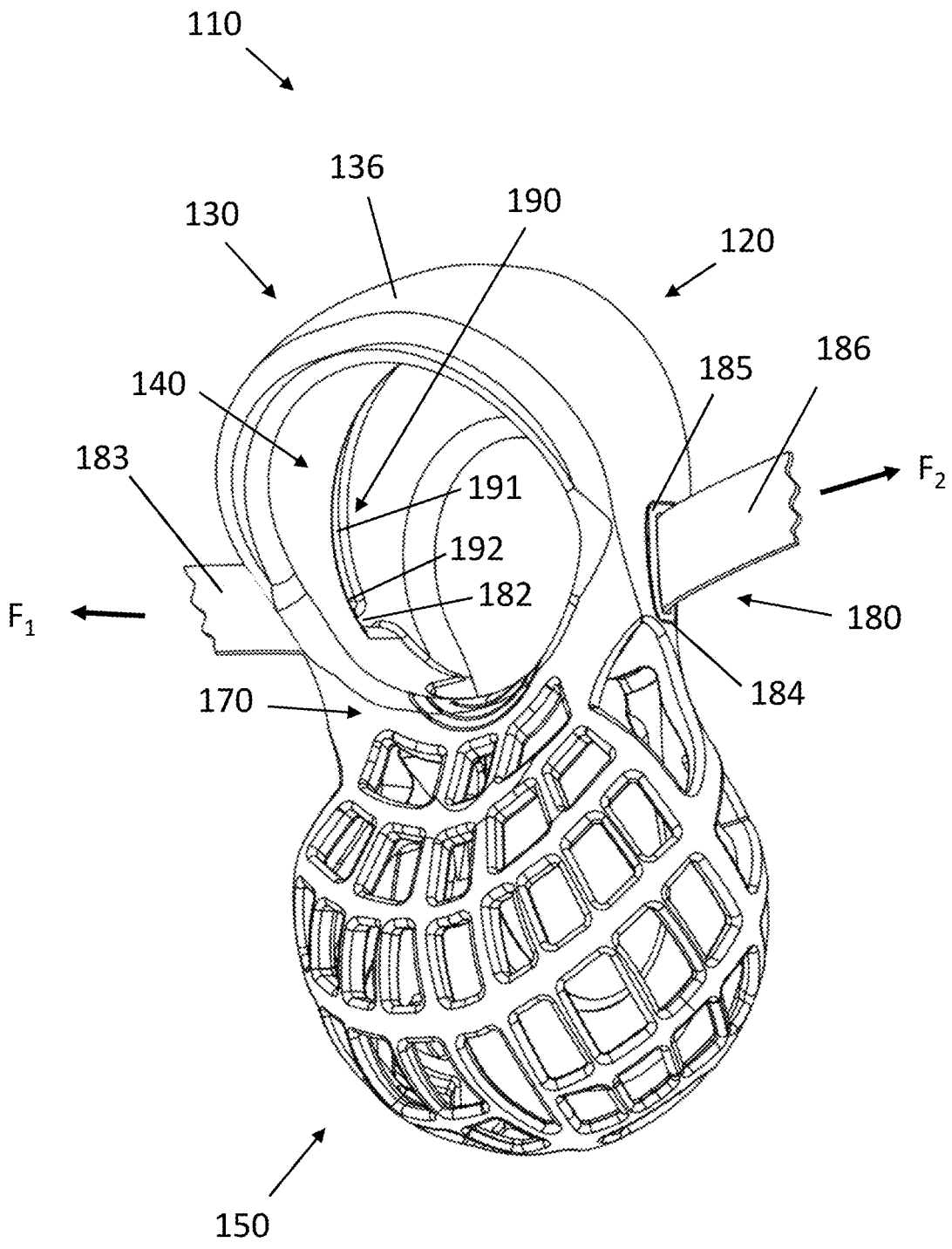
FIG. 9 depicts a perspective view of another exemplary support apparatus.

As shown in FIG. 9, genitalia support apparatus 110 may similarly comprise a body 120 defining: a first structure 130, a second structure 150, and a third structure 170; and an attachment element 180 configured to secure body 120 against a wearer. In contrast to above, first structure 130 of FIG. 9 may comprise a reinforcement element 190 configured to maintain a shape of body 120 when support apparatus 110 is worn by limiting deflections caused by forces applied thereto by wearer 1 or their clothing, such as lateral forces $F_1$ and $F_2$.

Reinforcing element 190 may comprise any material that is attachable to, embeddable in, and/or formed integral with body 120. As shown in FIG. 9, first structure 130 may similarly comprise a protective hood 136, and a conduit 140 extending through protective hood 136. For example, body 120 may comprise a first material, such as medical grade silicone; and reinforcing element 190 may comprise a second material that is attached to, embedded in, or formed integral with protective hood 136. A shape of reinforcing element 190 and/or a composition of the second material may be configured to maintain a shape of body 120 when support apparatus 110 is worn (e.g., a diameter of conduit 140) by reinforcing the first material at one or more structures of body 120. Any second material may be used in any form, including any polymeric material(s), including thermoplastics, like PEEK.

Reinforcing element 190 may comprise a structural frame 191 that is removably attachable to body 120. As shown in FIG. 10, attachment element 180 may comprise portions of body 120, such as a first attachment opening 182, a second attachment opening 184, and a frame receiving channel 186 in communication with attachment openings 182 and 184. Attachment openings 182 and 184 may extend partially into protective hood 136; and channel 186 may extend partially into a conduit defining surface 146 of conduit 140, between openings 182 and 184. A shape of structural frame 191 may correspond with a shape of first attachment opening 182, second attachment opening 184, and channel 186, allowing frame 191 to be snapped into opening 182, opening 184, and/or channel 186.

Figure 10:
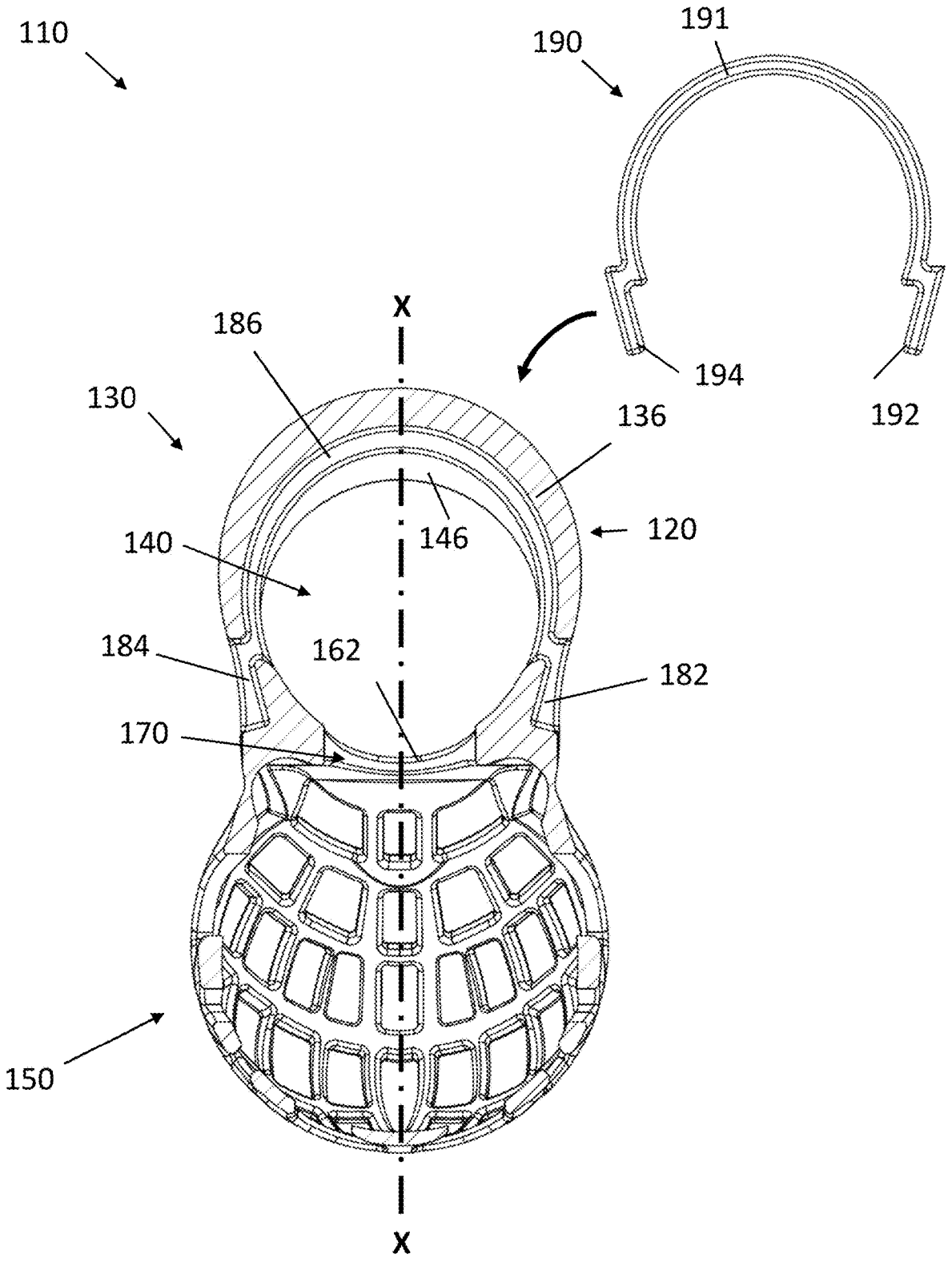
FIG. 10 depicts a cross-sectional back view of the FIG. 9 apparatus along a section line similar to section line B-B of FIG. 4.
Figure 11:
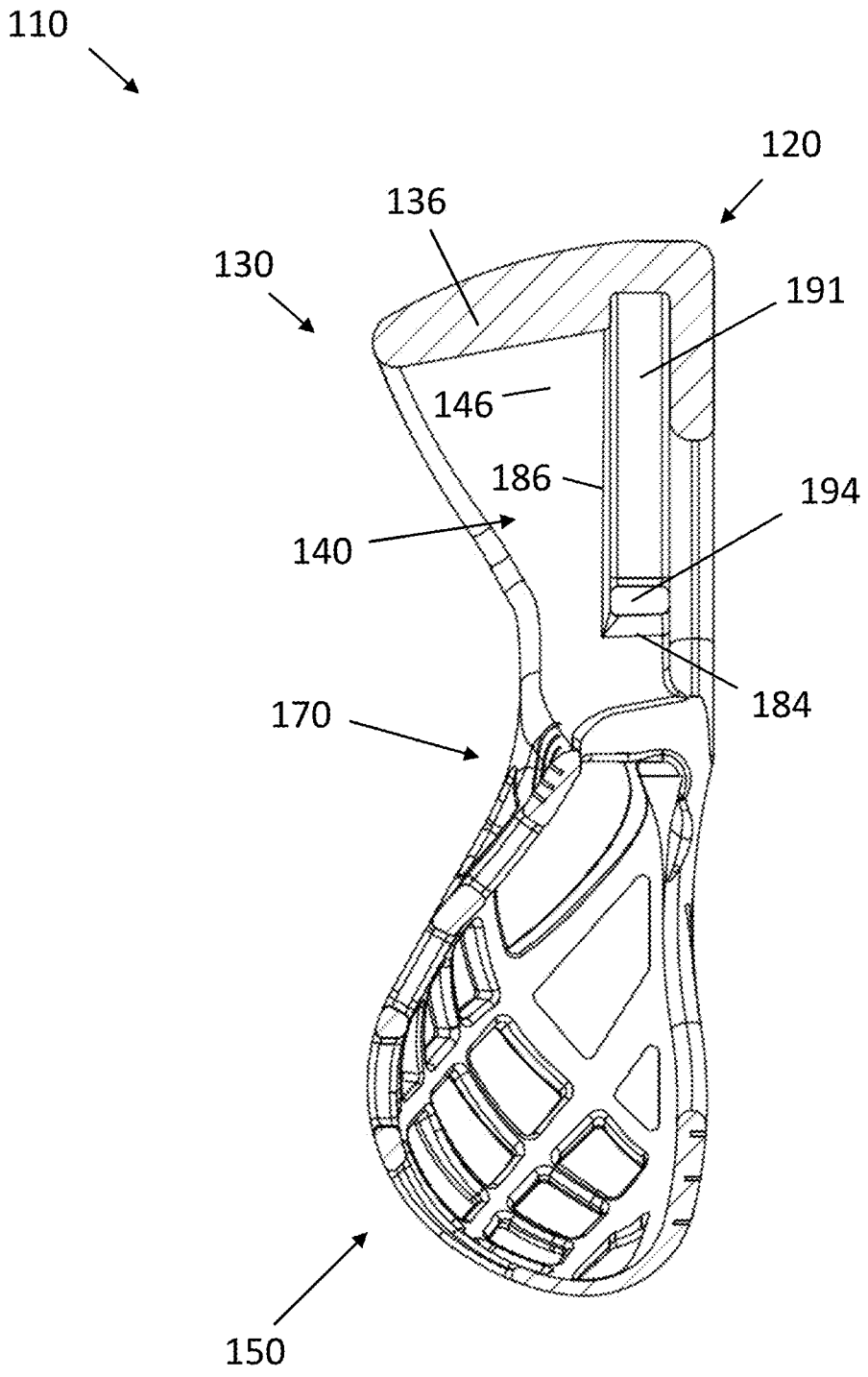
FIG. 11 depicts a cross-sectional side view of the FIG. 9 apparatus taken along a section line similar to section line A-A of FIG. 2.

As shown in FIG. 10, body 120 may be comprised of a flexible material (e.g., medical grade silicone); structural frame 191 may be comprised of a rigid polymeric material (e.g., PEEK, PVC, and the like); and each end 192 and 194 of frame 191 may be keyed to obtain a snap-fit with attachment openings 182 and 184. For example, structural frame 191 may have a diameter that is slightly larger than a diameter of conduit 140, allowing frame 191 to apply a tensioning force to body 120 that maintains a shape of body 120, such as the diameter of conduit 140; and secures structural frame 191 in frame receiving channel 186. As shown in FIGS. 10 and 11, each end 192 and 194 may be located in one of openings 182 and 184 to seat frame 191 in channel 186.

Reinforcing element 190 may be engageable with attachment element 180. For example, each end 192 and 194 of structural frame 191 may be engageable with another attachment element, such as a strap, tape, and/or another garment. As shown in FIGS. 9, 10, and 11, end 192 may be seated in opening 182 and removably attachable to an end connector of a strap portion 183; and end 194 may be seated in opening 184 and removably attachable to an end connector 185 of a strap portion 186. In this configuration, when body 120 is worn, lateral forces $F_1$ and $F_2$ may be applied to strap portions 183 and 186 and transferred into structural frame 191 via the end connectors of strap portions 183 and 186. Frame 191 may be configured to resist forces $F_1$ and $F_2$. For example, a cross-sectional shape, a diameter, and/or a material composition of structural frame 191 may allow it to function as a curved beam configured to limit lateral deflections at ends 192 and 194. As a further example, the connection between ends 192 and 194 and strap portions 183 and 186 may allow the entirety of lateral forces $F_1$ and $F_2$ to be transferred into frame 191 without substantial deformations of body 120.

Any number and shape of structural frame(s) 191 may be used to similarly reinforce body 120. For example, reinforcing element 190 also may comprise: a plurality of structural frames 191; a material composition of first structure 130; and a reinforcing mesh embedded in protective hood 136. Either body 120 and/or reinforcing member 190 may comprise shape memory materials. For example, structural frame 191 may comprise a shape memory metal and/or polymer configured to both resist lateral forces $F_1$ and $F_2$, and restore the shape of body 120 after removal of any other forces applied thereto.

In some aspects, genitalia support apparatus 10 and/or 110 may be maintained against skin of wearer 1, at a generally fixed location, for extended durations of time (e.g., hours), making it a desirable support frame for other objects. An example is now described with reference to FIGS. 12 and 13, which reference an exemplary cover 210. For ease of description, aspects of cover 210 are shown and described with reference to body 20 of support apparatus 10.

Figure 12:
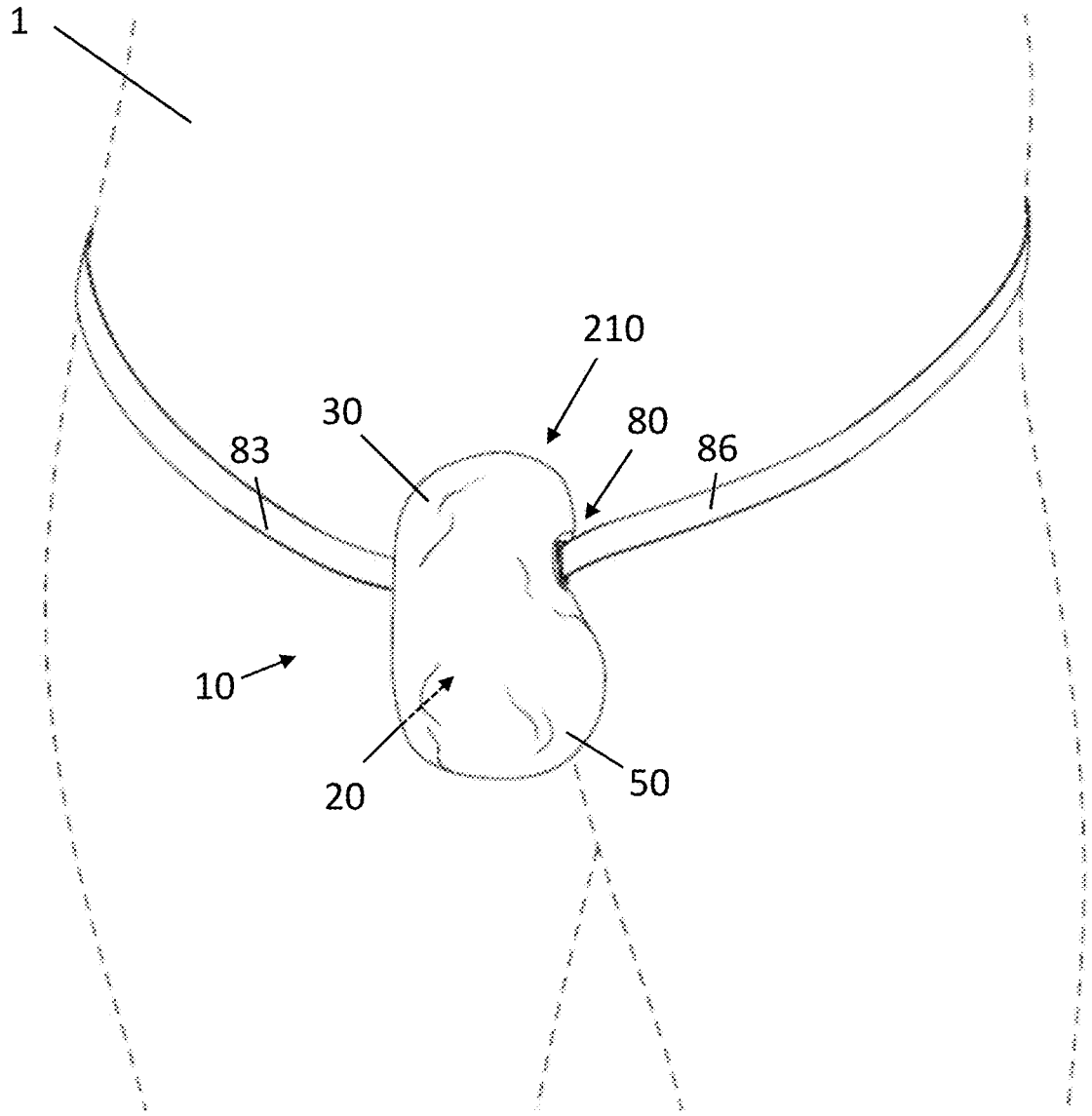
FIG. 12 depicts a perspective view of an exemplary support apparatus and an exemplary cover being worn by a wearer.

As shown in FIG. 12, cover 210 may comprise any type of covering material that is attached to body 20 and configured to protect penis 2 or scrotum 3 from one or more elements. For example, for circumcised males, cover 210 may comprise a thin fabric configured to protect a tip of penis 2 from movement-induced injuries caused by interactions between the circumcised tip and an interior surface of the wearer's clothing. As a further example, for incontinent males, cover 210 may comprise moisture absorbing and/or retaining elements configured to retain a predetermined amount of moisture (e.g., an amount equivalent to one or more bladder voids of an adult male), much like a diaper. As yet another example, for athletic males, cover 210 also may comprise additional impact absorption and/or deflective layers configured to prevent impact related injuries to penis 2 or scrotum 3. For example, cover 210 may have a rigid shape and/or a supporting structure.

However cover 210 is configured, body 20 may be configured to limit deflections caused by forces and any additional weight associated with cover 210. For example, a rigidity of first structure 30 may be configured to limit deflections caused by lateral forces $F_1$ and $F_2$ (e.g., FIG. 8) and the additional weight. Alternatively, if cover 210 is used with support apparatus 110, then reinforcing element 190 may be configured to limit the deflections. For example, if cover 210 comprises moisture absorbing and/or retaining elements, then the additional weight may comprise a weight of those elements and the predetermined amount of moisture; and one or both of cover 210 and/or reinforcing element 190 may be configured to support the additional weight without substantial deformations of body 120.

Figure 13:
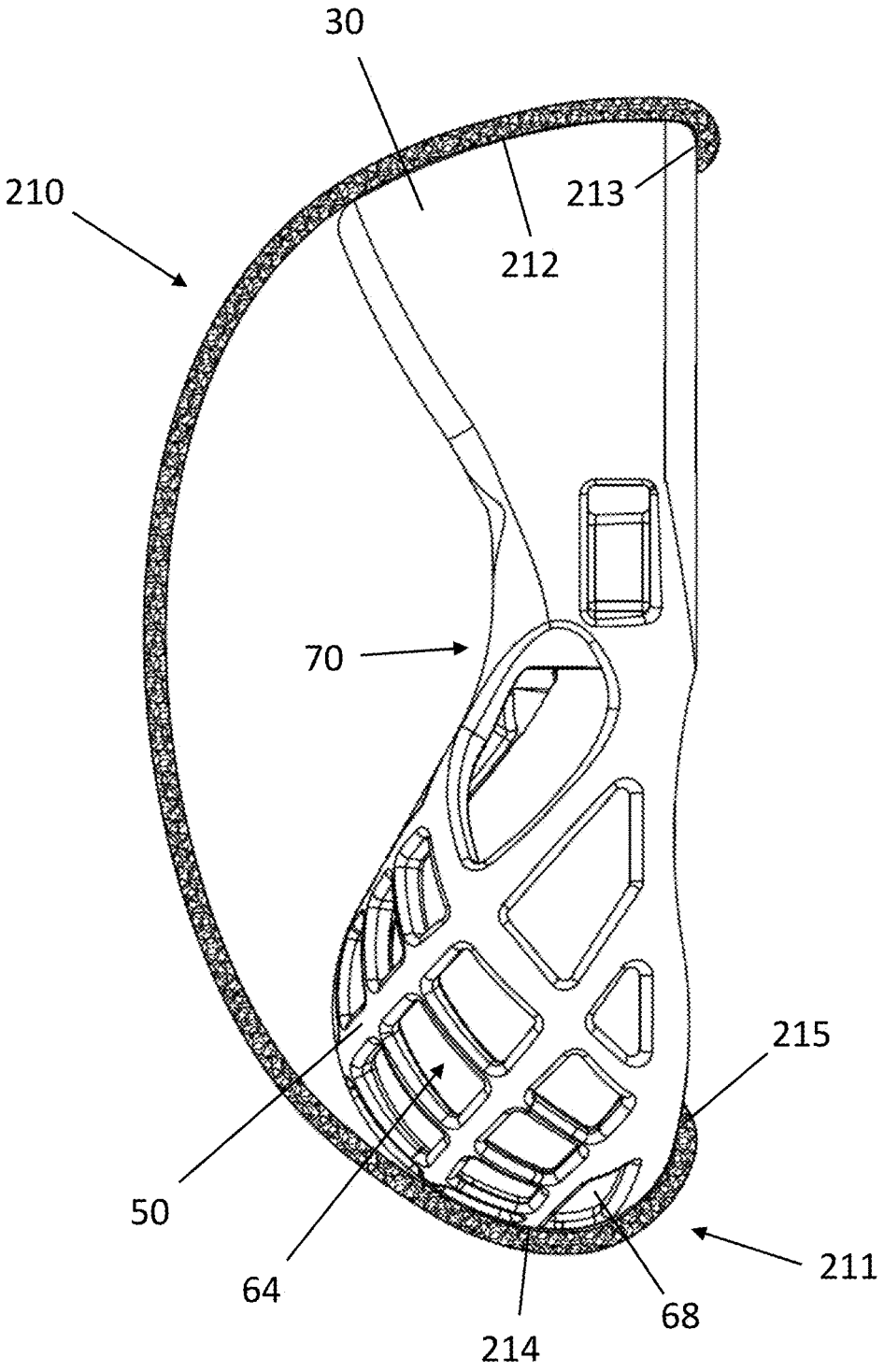
FIG. 13 depicts a cross-sectional side view of the FIG. 12 apparatus and cover.

As also shown in FIG. 13, interior surfaces 212, 214 and/or edges 213, 215 of cover 210 may be removably attachable to exterior and/or interior surfaces of body 20. For example, interior surfaces 212 and/or edges 213 may comprise an adhesive engageable with outer surfaces of first structure 30 of body 20 and interior surfaces 214 and/or edges 215 may comprise an adhesive engageable with outer surfaces of second structure 50 of body 20. As a further example, surfaces 212, 214 and/or edges 213, 215 also may comprise interlocking attachment features engageable with corresponding features of body 10, such as snaps, Velcro®, and the like. Further still, portions of cover 210 (e.g., surfaces 212, 214 and/or edges 213, 215) may comprise elastic elements that are conformable around body 20. For example, the elastic elements may extend at least partially around a perimeter of cover 210, allowing it to be stretched elastically around one or more exterior portions of body 20 when removably attached thereto.

Any combination of attachment features may be used. For example, if cover 210 comprises moisture absorbing and/or retaining elements, then the attachment features may be configured to maintain a moisture-tight seal between cover 210 and the exterior surfaces of body 20. For example, as shown in FIG. 13, a bottom portion 211 of cover 210 may wrap around second structure 50, creating a moisture capture area; and edge 215 may comprise adhesive and/or elastic elements positionable to form a moisture-tight seal with exterior surfaces of body 20 so that fluids draining out of chamber 56 through one or more openings 64 (e.g., openings 68) are directed into the moisture capture area. As a further example, cover 210 may be suspended from a portion of body 20 by the elastic elements, allowing it to support the weight of the moisture without being sealed against body 20.

Any number of alternative and/or additional objects also may be similarly attached to and supported by body 20. For example, exterior surfaces of protective hood 36 and/or interior surfaces of conduit 40 may comprise one or more attachment structures (e.g., clamps or hooks) configured to removably attach a portion of a condom (e.g., a posterior portion) to body 20 (e.g., protective hood 36). As a further example, any surface of body 20 also may comprise protrusions or openings engageable with any other objects, such as a sensor or other electronic device.

As described above, genitalia support apparatus 10 and 110 may be worn under any garment. First structures 30, 130 and second structures 50, 150, respectively, may at least partially surround penis 2 and scrotum 3. For example, first structures 30, 130 may protect penis 2 from compression while allowing it to rest naturally in a downward position; and second structures 50, 150 may limit sagging of scrotum 3. Other aspects of bodies 20, 120 may accommodate different sizes and/or performance features. For example, at least second structures 50, 150 may comprise a biocompatible material (e.g., silicone) defining a combination of solid and webbed surfaces configured to maintain a cool skin feel by maintaining separations between penis 2, scrotum 3, and the thighs wearer 1. Accordingly, when properly fitted, apparatus 10 and 110 may be worn without folding, cramping, pinching, or binding penis 2 and/or scrotum 3.

Although described independently, it is contemplated that aspects of support apparatus 10 and 110 (e.g., any of first structures 30, 130, second structures 50, 150, and third structures 70, 170) may be integrated into any known undergarments, such as briefs, boxers, and the like. For example, without departing from this disclosure, the structures defining conduits 40, 140 and/or chambers 56, 156 may be integrated into the pouch of a traditional brief or boxer brief, or a protective cup for traditional jock straps. As a further example, these traditional undergarments also may serve as attachment elements 80, 180.

Without limiting any of the aspects described herein, ornamental designs of the structures shown in the drawings are also disclosed. Some of the described aspects may be optional features in some of the designs. For example, in some ornamental designs, portions of first structures 30, 130, second structures 50, 150, and/or third structures 70, 170 may be optional features and/or form no part of the design. As a further example, in some ornamental designs, any or all of plurality of openings 64 may be optional features and/or form no part of the design. Some ornamental designs may consist of any ornamental features visible from any perspective relative to the orientations shown in the drawings.

While principles of the present disclosure are described herein with reference to illustrative aspects for particular applications, the disclosure is not limited thereto. Those having ordinary skill in the art and access to the teachings provided herein will recognize additional modifications, applications, aspects, and substitution of equivalents all fall in the scope of the aspects described herein. Accordingly, the present disclosure is not to be considered as limited by the foregoing description.

Embodiments in which an exclusive property or privilege is claimed are defined as follows:

1. An apparatus for supporting a penis and a scrotum of a wearer, the apparatus comprising:

a non-fabric body comprising a silicone material configured to define a predetermined shape comprising:

a first structure comprising a first posterior wall positionable against a pubic area of the wearer and a first anterior wall extending outwardly from the first posterior wall in an anterior direction to define a protective hood sized to at least partially surround a posterior portion of the penis, the protective hood comprising (i) a cross-section extending from an upper portion of the first posterior wall in the anterior direction, being configured to tent clothing over the penis in a flaccid state, and having a thickened portion configured to increase a rigidity of the first structure, (ii) a penis inlet opening extending through the first posterior wall, and (iii) a penis outlet opening extending through the first anterior wall;

a second structure comprising a second posterior wall contiguous with the first posterior wall and positionable against thighs of the wearer to maintain a separation between a posterior portion of the scrotum and the thighs, a second anterior wall extending from the second posterior wall to define a protective shell comprising a chamber sized to at least partially surround the scrotum, and a scrotum inlet opening extending through the second posterior wall and configured to receive the scrotum in the chamber, a perimeter of the scrotum inlet opening being offset from the second anterior wall and configured so that the posterior portion of the scrotum acts against an anterior surface of the second posterior wall to retain the scrotum in the chamber during movements of the wearer, the second anterior wall comprising a plurality of ventilation openings extending into the chamber; and a third structure comprising a dividing surface positionable to maintain a separation between an anterior portion of the scrotum and the penis when the second posterior wall of the second structure is positioned to maintain the separation between the posterior portion of the scrotum and the thighs; and an attachment element configured to maintain the non-fabric body in a position relative to the wearer such that the second posterior wall of the second structure is positioned to maintain the separation between the posterior portion of the scrotum and the thighs and the dividing surface of the third structure is positioned to maintain the separation between the anterior portion of the scrotum and the penis.

2. The apparatus of claim 1, wherein the silicone material has been formed or printed to define the predetermined shape.

3. The apparatus of claim 1, wherein the non-fabric body comprises a non-fibrous material or a non-woven material.

4. The apparatus of claim 1, wherein the attachment element is removably attachable to the non-fabric body.

5. The apparatus of claim 1, comprising a reinforcing element that is:

attachable to, embedded in, or formed integral with the non-fabric body; and configured to resist deformations from forces applied to the non-fabric body by the attachment element.

6. The apparatus of claim 5, wherein the attachment element is removably attachable to the non-fabric body or the reinforcing element.

7. The apparatus of claim 1, wherein the non-fabric body has a Young's modulus of at least 33 MPa.

8. The apparatus of claim 1, wherein:

at least a portion of the dividing surface is removable to accommodate a size of the penis; and at least a portion of the second posterior wall is removable to accommodate a size of the scrotum.

9. The apparatus of claim 1, wherein the plurality of ventilation openings comprise a flexibility-enhancing opening or a drainage opening.

10. The apparatus of claim 1, further comprising a cover that is removably attachable to the non-fabric body or the attachment element.

11. The apparatus of claim 10, wherein the cover comprises a layer of fabric.

12. The apparatus of claim 10, wherein the cover is impact absorbing.

13. The apparatus of claim 10, wherein:

the plurality of ventilation openings comprise one or more drainage openings configured to drain fluids from the chamber;

the cover comprises a moisture retaining element configured to retain a predetermined amount of the fluids equal to at least one bladder void of the wearer; and at least a portion of the moisture retaining element is positioned at the one or more drainage openings when the cover is removably attached to the non-fabric body.

14. The apparatus of claim 13, wherein a portion of the cover is engageable with the non-fabric body to maintain a position of the moisture retaining element at the one or more drainage openings.

15. The apparatus of claim 14, wherein the portion of the cover comprises an adhesive or an elastic element.

16. The apparatus of claim 1, wherein the dividing surface comprises a concave surface.

17. The apparatus of claim 1, wherein the attachment element is configured to suspend a weight of the non-fabric body, the penis, and the scrotum from a waist of the wearer.

18. The apparatus of claim 17, wherein:

the attachment element comprises a strap engageable with the non-fabric body and configured to suspend the weight; and at least the first structure is configured to resist lateral forces applied by the strap when suspending the weight.

19. The apparatus of claim 1, wherein the penis inlet opening and the scrotum inlet opening are in communication with one another to define a single inlet opening configured for accommodating the penis and the scrotum of the wearer.

20. The apparatus of claim 19, wherein:

the penis inlet opening defines an upper diameter of the single inlet opening;

the scrotum inlet opening defines a lower diameter of the single inlet opening; and a perimeter of the single inlet opening is defined by intersections of the upper and lower diameters of the penis and scrotum inlet openings.

* * * * *